US010397696B2

(12) United States Patent
Sullivan et al.

(10) Patent No.: US 10,397,696 B2
(45) Date of Patent: Aug. 27, 2019

(54) OMNI-DIRECTIONAL SPEAKER SYSTEM AND RELATED DEVICES AND METHODS

(71) Applicant: Bose Corporation, Framingham, MA (US)

(72) Inventors: Donna Marie Sullivan, Brimfield, MA (US); Wontak Kim, Watertown, MA (US)

(73) Assignee: Bose Corporation, Framingham, MA (US)

( * ) Notice: Subject to any disclaimer, the term of this patent is extended or adjusted under 35 U.S.C. 154(b) by 275 days.

(21) Appl. No.: 15/221,906

(22) Filed: Jul. 28, 2016

(65) Prior Publication Data

US 2017/0303034 A1 Oct. 19, 2017

Related U.S. Application Data

(63) Continuation-in-part of application No. 14/643,216, filed on Mar. 10, 2015, now Pat. No. 9,544,681.

(60) Provisional application No. 62/110,493, filed on Jan. 31, 2015.

(51) Int. Cl.

| | |
|---|---|
| ***H04R 1/34*** | (2006.01) |
| ***H04R 1/40*** | (2006.01) |
| ***H04R 1/28*** | (2006.01) |

(52) U.S. Cl.

CPC ..... *H04R 1/345* (2013.01); *H04R 1/288* (2013.01); *H04R 1/2811* (2013.01); *H04R 1/34* (2013.01); *H04R 1/403* (2013.01); *H04R 1/2834* (2013.01); *H04R 2201/34* (2013.01)

(58) Field of Classification Search

CPC .... H04R 1/2811; H04R 1/2834; H04R 1/288; H04R 1/34; H04R 1/345; H04R 1/403; H04R 1/2896; H04R 2201/34; H04R 1/26; H04R 2400/13

USPC ..... 381/339, 160, 342, 352, 353, 354, 182, 381/186; 181/151, 155, 156, 199

See application file for complete search history.

(56) References Cited

U.S. PATENT DOCUMENTS

| | | | |
|---|---|---|---|
| 3,892,917 | A | 7/1975 | Sotome |
| 3,912,866 | A | 10/1975 | Fox |
| 4,322,578 | A | 3/1982 | Selmin |
| 4,348,549 | A | 9/1982 | Berlant |
| 4,620,317 | A | 10/1986 | Anderson |
| 5,115,882 | A | 5/1992 | Woody |

(Continued)

FOREIGN PATENT DOCUMENTS

| | | | |
|---|---|---|---|
| CA | 2795676 | A1 | 12/2011 |
| DE | 102011016326 | A1 | 10/2012 |

(Continued)

OTHER PUBLICATIONS

Mcritchie, Don, "Aquarius: A Noble Experiment", Audioheritage.com, 2001, accesses Mar. 5, 2015, 9 pages.

(Continued)

*Primary Examiner* — Huyen D Le

(57) ABSTRACT

An omni-directional speaker system includes a deflector sub-assembly and a pair of acoustic sub-assemblies. The deflector sub-assembly includes a pair of diametrically opposed acoustic deflectors. Each of the acoustic sub-assemblies includes an acoustic driver for radiating acoustic energy toward an associated one of the acoustic deflectors. The acoustic sub-assemblies are coupled together via the deflector sub-assembly.

17 Claims, 10 Drawing Sheets

(56) References Cited

U.S. PATENT DOCUMENTS

| | | | | |
|---|---|---|---|---|
| 5,268,538 | A | 12/1993 | Queen | |
| 5,673,329 | A * | 9/1997 | Wiener | H04R 1/34 181/144 |
| 5,995,634 | A * | 11/1999 | Zwolski | H04R 1/028 181/155 |
| 6,009,972 | A | 1/2000 | Choi et al. | |
| 6,026,928 | A | 2/2000 | Maharaj | |
| 6,064,744 | A | 5/2000 | Augustin | |
| 6,257,365 | B1 | 7/2001 | Hulsebus, II | |
| D476,310 | S | 6/2003 | Hisatsune | |
| D476,311 | S | 6/2003 | Hisatsune | |
| 6,597,797 | B1 | 7/2003 | Betts | |
| D508,042 | S | 8/2005 | Oikawa | |
| D521,979 | S | 5/2006 | Ishibashi | |
| D545,299 | S | 6/2007 | Tsuge | |
| D581,397 | S | 11/2008 | Masui | |
| D581,398 | S | 11/2008 | Sugiyama | |
| D591,266 | S | 4/2009 | Motoishi | |
| D600,287 | S | 9/2009 | Oikawa et al. | |
| D646,665 | S | 10/2011 | Iijima | |
| 8,130,994 | B2 | 3/2012 | Button et al. | |
| 8,181,736 | B2 | 5/2012 | Sterling et al. | |
| 8,290,195 | B2 | 10/2012 | Chick et al. | |
| 8,418,802 | B2 | 4/2013 | Sterling et al. | |
| 8,467,557 | B2 | 6/2013 | Miller et al. | |
| 8,672,088 | B2 | 3/2014 | Sterling et al. | |
| 8,750,540 | B2 | 6/2014 | Tan | |
| 9,282,398 | B2 | 3/2016 | Monroe | |
| 2002/0011379 | A1 | 1/2002 | Taylor | |
| 2003/0141142 | A1 | 7/2003 | Christiansen | |
| 2008/0192972 | A1 | 8/2008 | Lewallen | |
| 2009/0245561 | A1 | 10/2009 | Litovsky et al. | |
| 2009/0310808 | A1 | 12/2009 | Button et al. | |
| 2012/0076328 | A1 | 3/2012 | Harwood | |
| 2012/0201403 | A1 | 8/2012 | Tan | |
| 2013/0213628 | A1 | 8/2013 | Litovsky et al. | |
| 2013/0228393 | A1 | 9/2013 | Sterling et al. | |
| 2014/0321686 | A1 | 10/2014 | Wegener | |
| 2016/0227315 | A1 | 8/2016 | Kim et al. | |
| 2016/0337748 | A1 | 11/2016 | Goksel et al. | |
| 2017/0006376 | A1 | 1/2017 | Tan | |
| 2017/0094403 | A1 | 3/2017 | Tipparaju et al. | |

FOREIGN PATENT DOCUMENTS

| | | | |
|---|---|---|---|
| EP | 0518668 | A2 | 12/1992 |
| JP | S59-121991 | U | 8/1984 |
| JP | S61219289 | A | 9/1986 |
| JP | S61264896 | A | 11/1986 |
| JP | S61264897 | A | 11/1986 |
| JP | H11-234784 | A | 8/1999 |
| JP | 2009141657 | A | 6/2009 |
| JP | 2010093767 | A | 4/2010 |
| WO | 98/09273 | A1 | 3/1998 |
| WO | 2011053248 | A1 | 5/2011 |

OTHER PUBLICATIONS

International Search Report and Written Opinion dated Apr. 7, 2016 for International application No. PCT/US2016/015521.

International Search Report and Written Opinion dated Apr. 6, 2017 for International application No. PCT/US2016/044682.

Invitation to Pay Additional Fees dated Apr. 5, 2017 for International application No. PCT/US2016/044680.

International Search Report and Written Opinion dated Jun. 28, 2017 for International application No. PCT/US2016/044680.

Visaton—Der Lautsprecherspezialist: "Kegel fur Rundstrahler", Apr. 8, 2012, pp. 1-8, XP055383099, retrieved from the Internet URL: http://www.visaton.de/vb/showthread.php?t=23544&highlight=f%C3%BC11en [retrieved on Jun. 20, 2017], p. 2—"Henrik" dialog input, p. 3—"walwal" 1st dialog input, p. 5—"walwal" dialog input.

First Office Action for Japanese Patent Application No. 2017-540589, dated Oct. 5, 2018.

International Search Report and Written Opinion dated Jun. 21, 2018 for International application No. PCT/US2018/025477.

First Office Action for Japanese Patent Application No. 2017540127, dated Jul. 2, 2018.

First Office Action for European Patent Application No. 16 704 759.6-1207, dated Jul. 16, 2018.

* cited by examiner

OMNI-DIRECTIONAL SPEAKER SYSTEM AND RELATED DEVICES AND METHODS

RELATED APPLICATION

This application is a continuation-in-part application of U.S. patent application Ser. No. 14/643,216, filed Mar. 10, 2015 and titled "Acoustic Deflector for Omni-Directional Speaker System," which claims benefit from U.S. Provisional Patent Application No. 62/110,493, filed Jan. 31, 2015 and titled "Acoustic Deflector for Omni-Directional Speaker System," the contents of which are incorporated herein by reference.

BACKGROUND

Conventional acoustic deflectors in speaker systems can exhibit artifacts in the acoustic spectrum due to acoustic modes present between an acoustic driver and an acoustic deflector. This disclosure relates to an acoustic deflector for equalizing the resonant response for an omni-directional speaker system.

SUMMARY

In one aspect, an omni-directional speaker system includes a deflector sub-assembly and a pair of acoustic sub-assemblies. The deflector sub-assembly includes a pair of diametrically opposed acoustic deflectors. Each of the acoustic sub-assemblies includes an acoustic driver for radiating acoustic energy toward an associated one of the acoustic deflectors. The acoustic sub-assemblies are coupled together via the deflector sub-assembly.

Implementations may include one of the following features, or any combination thereof.

In some implementations, each of the acoustic sub-assemblies includes an acoustic enclosure, and the deflector sub-assembly is coupled to the acoustic sub-assemblies so as to enable formation of respective acoustic seals at respective junctions between associated ones of the acoustic drivers and the acoustic enclosures.

In certain implementations, the pair of acoustic sub-assemblies includes a first acoustic sub-assembly. The first acoustic sub-assembly includes a first acoustic driver and a first acoustic enclosure. The first acoustic driver is coupled to the first acoustic enclosure via a first pair of fasteners partially forming a first acoustic seal at a junction between the first acoustic driver and the first acoustic enclosure. The deflector sub-assembly is coupled to the first acoustic sub-assembly via a second pair of fasteners so as to complete the first acoustic seal.

In some examples, each fastener of the second pair of fasteners passes through respective holes in the deflector sub-assembly and the first acoustic driver, and threadingly engages the first acoustic enclosure.

In certain examples, the pair of acoustic sub-assemblies also includes a second acoustic sub-assembly. The second acoustic sub-assembly includes a second acoustic driver and a second acoustic enclosure. The second acoustic driver is coupled to the second acoustic enclosure via a third pair of fasteners partially forming a second acoustic seal at a junction between the second acoustic driver and the second acoustic enclosure. The deflector sub-assembly is coupled to the second acoustic sub-assembly via a fourth pair of fasteners so as to complete the second acoustic seal.

In some cases, each fastener of the fourth pair of fasteners passes through respective holes in the second acoustic enclosure and the second acoustic driver, and threadingly engages the deflector sub-assembly.

In certain cases, the deflector sub-assembly includes a plurality of vertical legs, and the deflector sub-assembly is coupled to the acoustic sub-assemblies via the vertical legs.

In some implementations, the deflector sub-assembly is coupled to a first one of the acoustic sub-assemblies via a first diametrically opposed pair of the vertical legs, and the deflector sub-assembly is coupled to a second one of the acoustic sub-assemblies via a second diametrically opposed pair of the vertical legs.

In certain implementations, the pair of diametrically opposed acoustic deflectors together define a common (shared) acoustic chamber.

In some examples, the deflector sub-assembly includes an acoustically absorbing member disposed within the acoustic chamber.

In certain examples, the acoustically absorbing member is held in a compressed state by the pair of diametrically opposed acoustic deflectors.

In some cases, the compression of the acoustically absorbing member changes an acoustic property of the acoustically absorbing member.

Another aspect features a method of assembling an omni-directional acoustic assembly. The method includes coupling a deflector sub-assembly that includes a pair of diametrically opposed acoustic deflectors to a first acoustic sub-assembly that includes a first acoustic enclosure and a first acoustic driver such that the first acoustic driver is arranged to radiate acoustic energy toward a first one of the acoustic deflectors. The method also includes coupling the deflector sub-assembly to a second acoustic sub-assembly that includes a second acoustic driver and a second acoustic enclosure such that the second acoustic driver is arranged to radiate acoustic energy toward a second one of the acoustic deflectors.

Implementations may include one of the above and/or below features, or any combination thereof.

In some implementations, the step of coupling the deflector sub-assembly to the first acoustic sub-assembly completes a first acoustic seal at a junction between the first acoustic driver and the first acoustic enclosure.

In certain implementations, the step of coupling the deflector sub-assembly to the first acoustic sub-assembly includes passing a fastener through respective holes in the deflector sub-assembly and the first acoustic driver, and screwing the fastener into threaded engagement with the first acoustic enclosure.

In some examples, the step of coupling the deflector sub-assembly to the second acoustic sub-assembly comprises passing a fastener through respective holes in the second acoustic enclosure and the second acoustic driver, and screwing the fastener into threaded engagement with the deflector sub-assembly.

In certain examples, the step of coupling the deflector sub-assembly to the first acoustic sub-assembly includes passing a first pair of fasteners through respective holes in the deflector sub-assembly and the first acoustic driver, and screwing the first pair of fasteners into threaded engagement with the first acoustic enclosure; and the step of coupling the deflector sub-assembly to the second acoustic sub-assembly includes passing a second pair of fasteners through respective holes in the second acoustic enclosure and the second acoustic driver, and screwing the second pair of fasteners into threaded engagement with the deflector sub-assembly.

Another aspect provides an acoustic deflector sub-assembly that includes a pair of diametrically opposed omni-directional acoustic deflectors, and a first pair of vertical legs for mounting to a first acoustic sub-assembly such that a first one of the acoustic deflectors is arranged to deflect acoustic energy radiated from the first acoustic sub-assembly. The acoustic deflector sub-assembly also includes a second pair of vertical legs for mounting to a second acoustic sub-assembly such that a second one of the acoustic deflectors is arranged to deflect acoustic energy radiated from the second acoustic sub-assembly.

Implementations may include one of the above and/or below features, or any combination thereof.

In some implementations, each of the omni-directional acoustic deflectors includes an acoustically reflective body that has a truncated conical shape including a substantially conical outer surface, a top surface, and a cone axis. Each acoustically reflective body has an opening in the top surface centered on the cone axis. An acoustically absorbing material is disposed at the openings in the top surfaces of the acoustically reflective bodies.

In certain implementations, the respective cone axes of the omni-directional acoustic deflectors are coaxial.

According to yet another aspect, an acoustic deflector sub-assembly includes a pair of diametrically opposed omni-directional acoustic deflectors. Each of the omni-directional acoustic deflectors includes an acoustically reflective body have a truncated conical shape including a substantially conical outer surface, a top surface and a cone axis. Each acoustically reflective body having an opening in the top surface centered on the cone axis. The acoustically reflective bodies together define a shared acoustic chamber that is acoustically coupled to the openings in the top surfaces of the acoustically reflective bodies.

Implementations may include one of the above and/or below features, or any combination thereof.

In some implementations, the acoustically reflective bodies include recesses disposed about their respective substantially conical outer surfaces.

DETAILED DESCRIPTION

Multiple benefits are known for omni-directional speaker systems. These benefits include a more spacious sound image when the speaker system is placed near a boundary, such as a wall within a room, due to reflections. Another benefit is that the speaker system does not have to be oriented in a particular direction to achieve optimum high frequency coverage. This second advantage is highly desirable for mobile speaker systems where the speaker system and/or the listener may be moving.

Figure 1A:
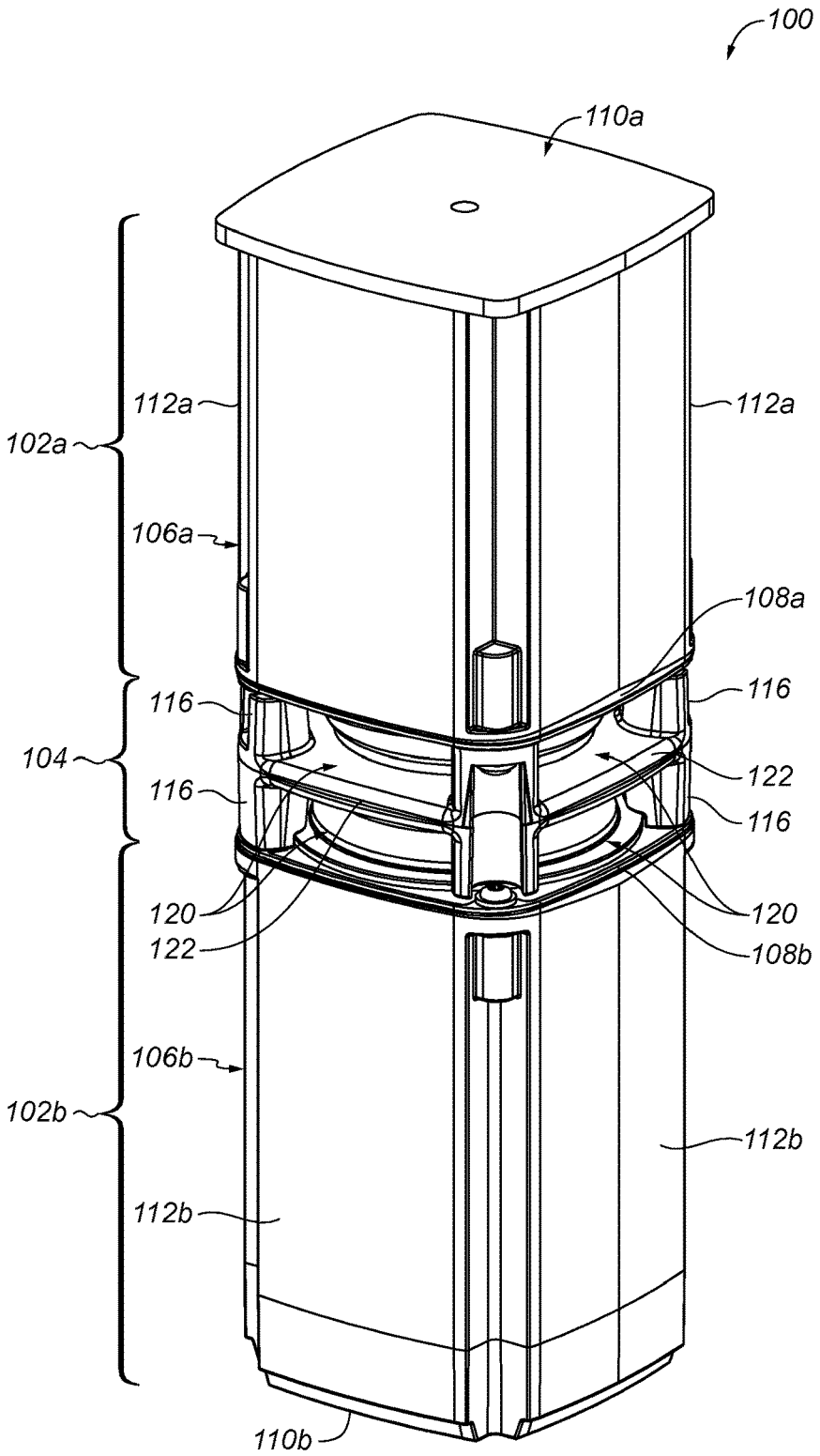
FIG. 1A is a perspective view of an acoustic assembly for an omni-directional speaker system.
Figure 1B:
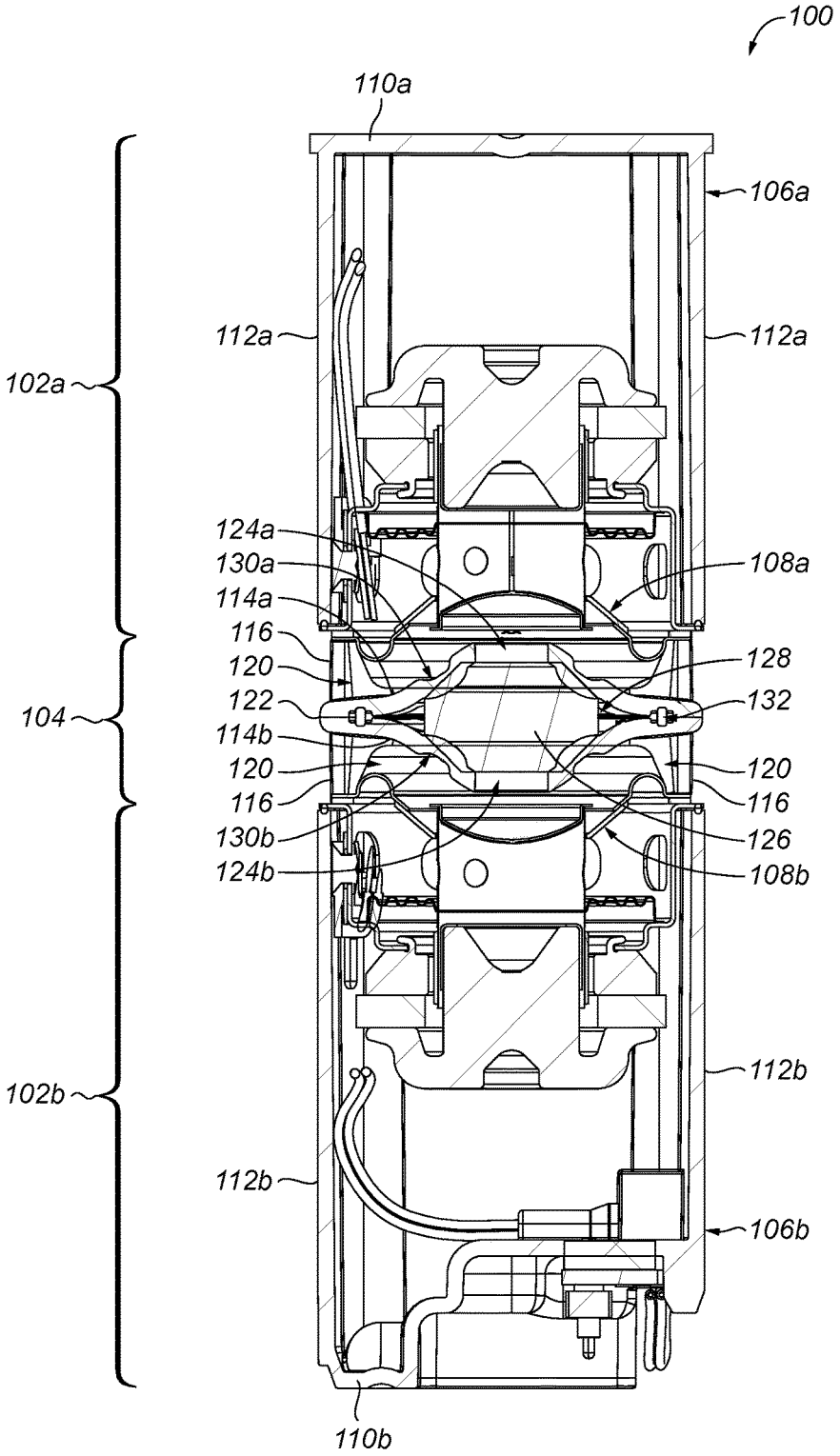
FIG. 1B is a cross-sectional side view of the acoustic assembly of FIG. 1A.

FIGS. 1A and 1B are perspective and cross-sectional views, respectively, of an acoustic assembly 100 for an omni-directional speaker system. The acoustic assembly includes a pair of diametrically opposing acoustic sub-assemblies 102*a*, 102*b* (collectively referenced as 102), which are coupled together via a common deflector sub-assembly 104. Each of the acoustic sub-assemblies 102 includes an acoustic enclosure 106*a*, 106*b* (collectively referenced as 106) and an acoustic driver 108*a*, 108*b* (collectively referenced as 108).

Each acoustic enclosure 108 includes a base 110*a*, 110*b* (collectively referenced as 110) and a plurality of sidewalls 112*a*, 112*b*, (collectively referenced as 112) which extend from the base to an opposing, open end. The associated acoustic driver 108 is secured to the open end such that a rear radiating surface of the driver radiates acoustic energy into the acoustic enclosure 106, and such that acoustic energy radiated from an opposing, front radiating surface of the acoustic driver 108 propagates toward the deflector sub-assembly 104.

The deflector sub-assembly includes 104 a pair of diametrically opposing omni-directional acoustic deflectors 114*a*, 114*b* (collectively 114). Each of the acoustic deflectors 114 has four vertical legs 116 to which a corresponding one of the acoustic sub-assemblies 102 is mounted. The acoustic sub-assemblies 102 are mounted such that the motion axes of their respective acoustic drivers 108 are coaxial.

Acoustic energy generated by the acoustic drivers 108 propagates toward the deflector sub-assembly 104 and is deflected into a nominal horizontal direction (i.e., a direction substantially normal to the motion axes of the acoustic drivers 108), by respective substantially conical outer surfaces of the acoustic deflectors 114. There are eight substantially rectangular openings 120. Each opening 120 is defined by one of the acoustic sub-assemblies, a base 122 of the deflector sub-assembly 104, and a pair of the vertical legs 116. These eight openings 120 are acoustic apertures which pass the horizontally propagating acoustic energy. It should be understood that the propagation of the acoustic energy in a given direction includes a spreading of the propagating acoustic energy, for example, due to diffraction.

As shown in FIG. 1B, each of the acoustic deflectors 114 has a nominally truncated conical shape. In other examples, the respective slopes of the conical outer surfaces, between the base and the vertex of the cone, are not constant. For example, one or both of the outer surfaces of the acoustic deflectors 114 may have a non-linear slant profile such as a parabolic profile or a profile described by a truncated hyperboloid of revolution. The bodies of the acoustic deflectors 114 can be made of any suitably acoustically reflective material. For example, the bodies may be formed from plastic, stone, metal, or other rigid materials.

In the illustrated example, each of the omni-directional acoustic deflectors 114 includes two features which may contribute to an improvement of the acoustic spectrum. First, there are acoustically absorbing regions disposed along the acoustically reflecting surface. As shown in FIG. 1B, each of these regions is arranged at an opening 124*a*, 124*b* (collectively 124), centered on the cone axis at the top of the truncated cone of the corresponding one of the acoustic deflectors 114, in which acoustically absorbing material 126 is disposed. This acoustically absorbing material 126 attenuates the energy present near or at the peak of the lowest order circularly symmetric resonance mode. In some implementations, the respective diameters of the openings 126 are chosen so that the resulting attenuation of the acoustic energy by the acoustic drivers 108 is limited to an acceptable level while achieving a desired level of smoothing of the acoustic spectrum.

In the illustrated implantation, the acoustically absorbing material 126 is foam (e.g., melamine foam). Notably, the bodies of the acoustic deflectors 114 together form a common body cavity 128 (a/k/a acoustic chamber), which, in the illustrated example, is filled with a single volume of foam such that the foam is adjacent to, or extends into, the openings. Alternatively, a separate foam element may be disposed at each opening so that only a portion of the body cavity 128 is occupied by foam. In one implementation, the foam present at each of the central openings 124 is at one end of a cylindrically-shaped foam element disposed within the body cavity 128. In some cases, the foam element is oversized and is compressed between the bodies of the acoustic deflectors 114 to achieve the desired acoustic properties (e.g., the desired acoustic absorptivity).

The body cavity 128, together with the openings 124, serves as a Helmholtz resonator (i.e., a shared, or dual, Helmholtz resonator) for attenuating a certain acoustic mode. By combining the volume between the two acoustic deflectors, there is more volume to work with in terms of trapping of the energy making the Helmholz resonator work. So sharing a common acoustic chamber effectively increases the volume that is available to each one of the deflectors individually, thereby increasing the amount of volume to kill the acoustic mode.

The second feature of the acoustic deflectors 114 that may contribute to an improvement in the acoustic spectrum is the presence of recesses 130*a*, 130*b* (a/k/a collectively 130), shown as ring shaped troughs, located along the circumferences of the nominally conical outer surfaces. In one example, the recesses 130 are each arranged at a circumference at a peak of the second harmonic of the resonance mode. In another example, one or both of the recesses 130 may be arranged at a radius that is approximately one-half of the base radius of the cone.

Alternatively or additionally, the recesses 130 may correspond with/to features of the acoustic driver. That is the recesses may be included to accommodate movement of features of the acoustic driver (e.g., movement of a diaphragm of the acoustic driver) relative to the omni-directional acoustic deflectors.

FIGS. 2A through 2F illustrate a step-wise assembly of an omni-directional speaker system that includes the acoustic assembly 100. Beginning with FIG. 2A, the bodies of the acoustic deflectors 114 are brought together, e.g., in a welding operation, to define the body cavity 128 (FIG. 1B) therebetween. In some examples, a hot plate welding procedure is employed to form a weld seam 132 (FIG. 1B) that couples the deflector bodies together and acoustically seals the body cavity 128 at the junction between the two deflector bodies. The weld seam 132 may be formed by a rib (e.g., a plastic rib) that is heated during a hot plate welding operation. A cylindrical piece of acoustically absorbing material 126 (e.g., foam) is disposed between the bodies and is compressed during the assembly operation to provide finished deflector sub-assembly 102 with the desired acoustic absorbing property.

Figure 2A:
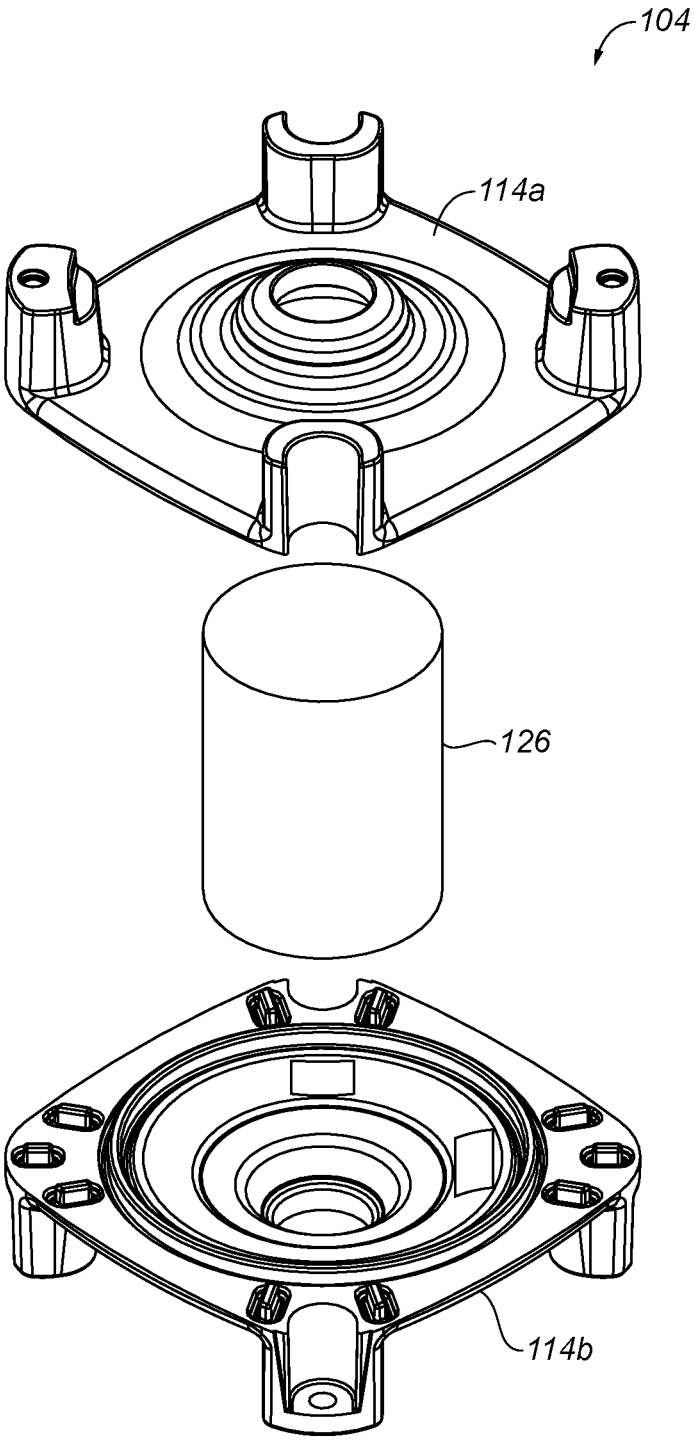
FIGS. 2A through 2F are perspective assembly views illustrating a step-wise assembly of an omni-directional sound system including the acoustic assembly of FIG. 1A.
Figure 2B:
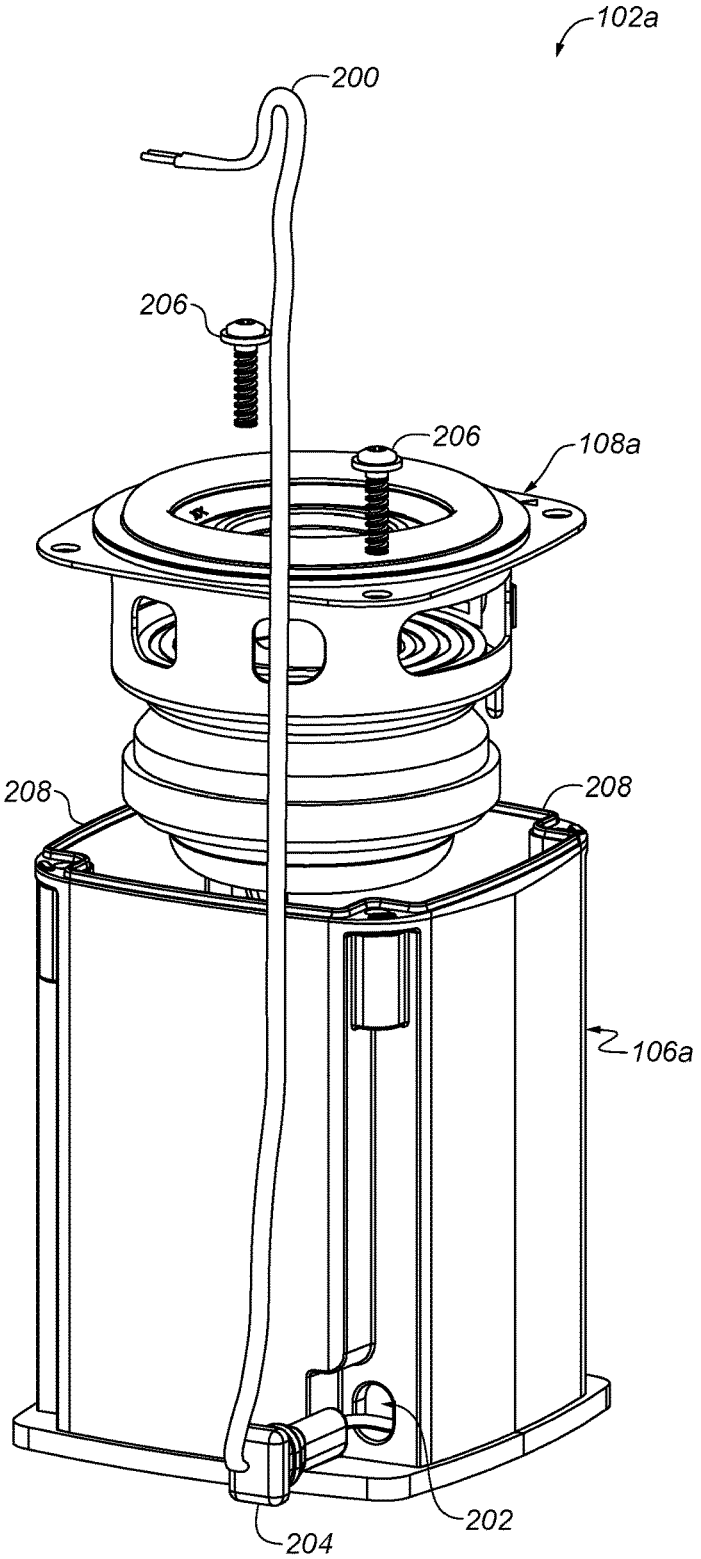

FIG. 2B illustrates the assembly of the first acoustic sub-assembly 102*a*. A first end of electrical wiring 200 is passed through an aperture 202 in the first acoustic enclosure 106*a*, via a grommet 204, and is connected to terminals (not shown) on the first acoustic driver 108*a*. The electrical wiring 200 provides electrical signals to the first acoustic driver 108*a* for driving the first acoustic driver 108*a*. The grommet 204 helps to assure that the aperture 202 in the first acoustic enclosure 106*a* is acoustically sealed in the final assembly.

The first acoustic driver 108*a* is then secured to the first acoustic enclosure 106*a* via a pair of fasteners 206 that pass through holes in a mounting bracket of the first acoustic driver 108*a* and threadingly engage the first acoustic enclosure 106*a*. In that regard, the fasteners 206 may engage pre-formed threaded holes in the first acoustic enclosure 106*a*, or they may form threaded holes as they engage the first acoustic enclosure 106*a*. A peripheral gasket 208 is provided at the open end of the first acoustic enclosure 106*a* to help provide an acoustic seal at the junction between the first acoustic driver 108*a* and the first acoustic enclosure 106*a*. Assembly of the second acoustic sub-assembly 102*b* (FIG. 1A) is substantially identical to that of the first acoustic sub-assembly 102*a*, and, thus, is not described for the sake of conciseness.

Figure 2C:
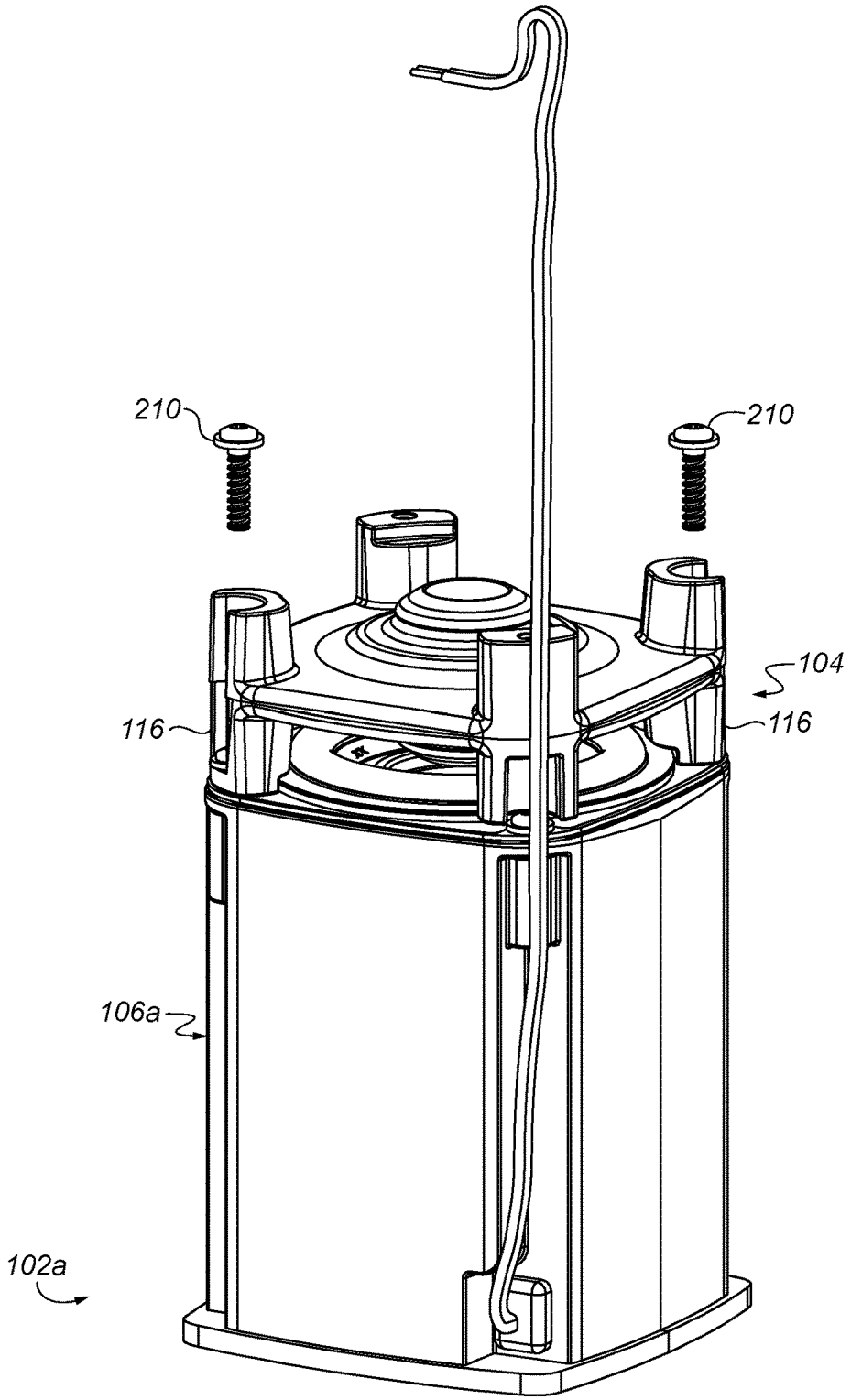

Next, referring to FIG. 2C, the deflector sub-assembly 104 is secured to the first acoustic sub-assembly 102*a* via a pair of fasteners 210 which pass through holes in a first pair of diametrically opposed ones of the vertical legs 116, then pass through holes in the mounting bracket of the first acoustic driver 108*a*, and then threadingly engage the first acoustic enclosure 106*a*. In that regard, the fasteners 210 may engage pre-formed threaded holes in the first acoustic enclosure 106*a*, or they may form threaded holes as they engage the first acoustic enclosure 106*a*. This completes the coupling of the deflector sub-assembly 104 to the first acoustic sub-assembly 102*a* and completes the acoustic seal at the junction between the first acoustic driver 108*a* and the first acoustic enclosure 106*a*.

Figure 2D:
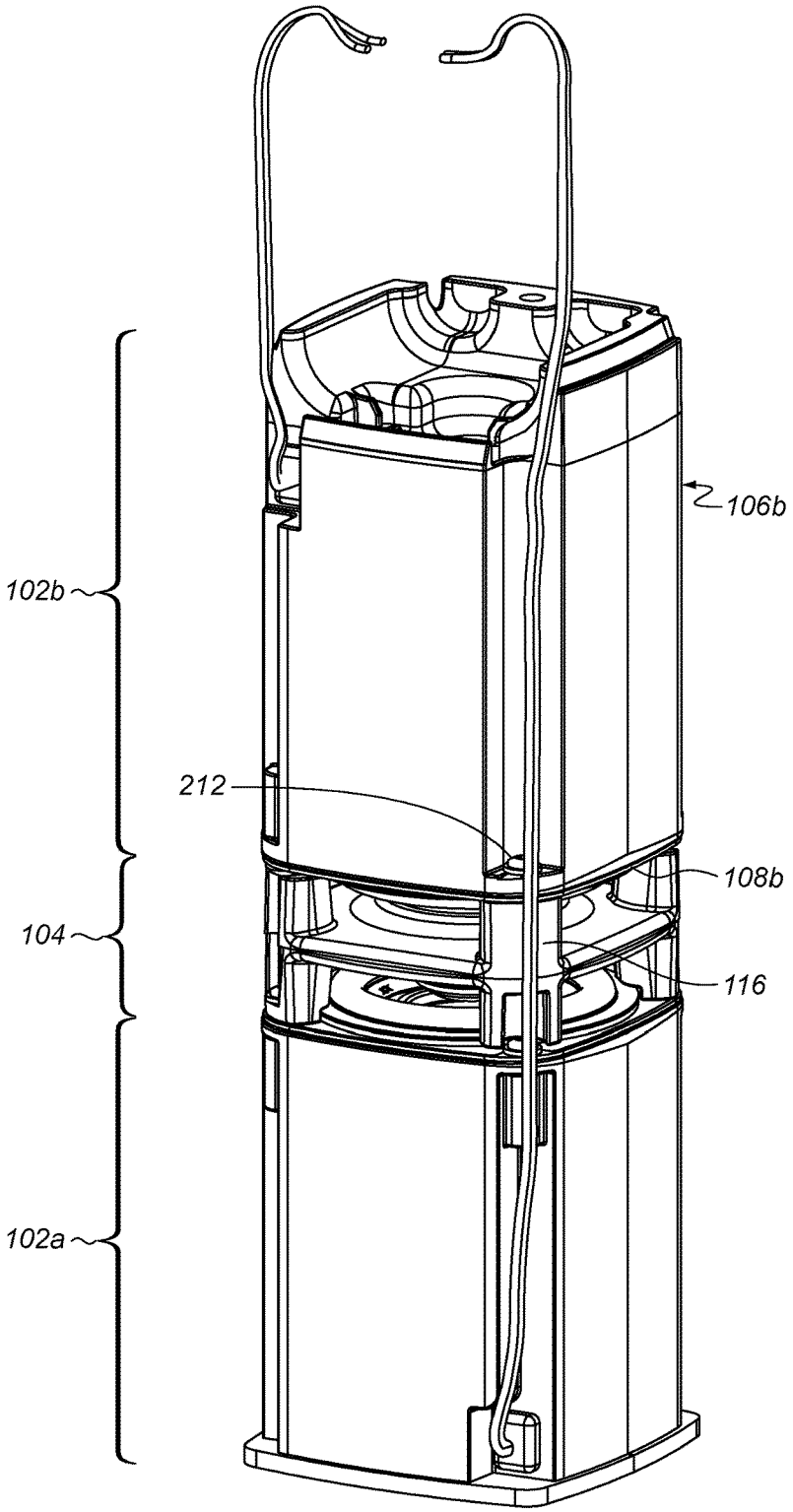

Referring to FIG. 2D, once the deflector sub-assembly 104 is fastened to the first acoustic sub-assembly 102*a*, the second acoustic sub-assembly 102*b* is coupled to the deflector sub-assembly 104 via another pair of fasteners 212 (one shown) which pass through holes in the second acoustic enclosure 106*b*, then pass through holes in a mounting bracket of the second acoustic driver 108*b*, and then threadingly engage a second pair of diametrically opposed ones of the vertical legs 116. In that regard, the fasteners 212 may engage pre-formed threaded holes in the vertical legs 116, or they may form threaded holes as they engage the vertical legs 116. This completes the coupling of the second acoustic sub-assembly 102*b* to the deflector sub-assembly 104 and completes the acoustic seal at the junction between the second acoustic driver 108*b* and the second acoustic enclosure 106*b*. Coupling the acoustic sub-assemblies 102 through the deflector sub-assembly 104 in this manner can help to eliminate the need for visible fasteners in the finished assembly.

Figure 2E:
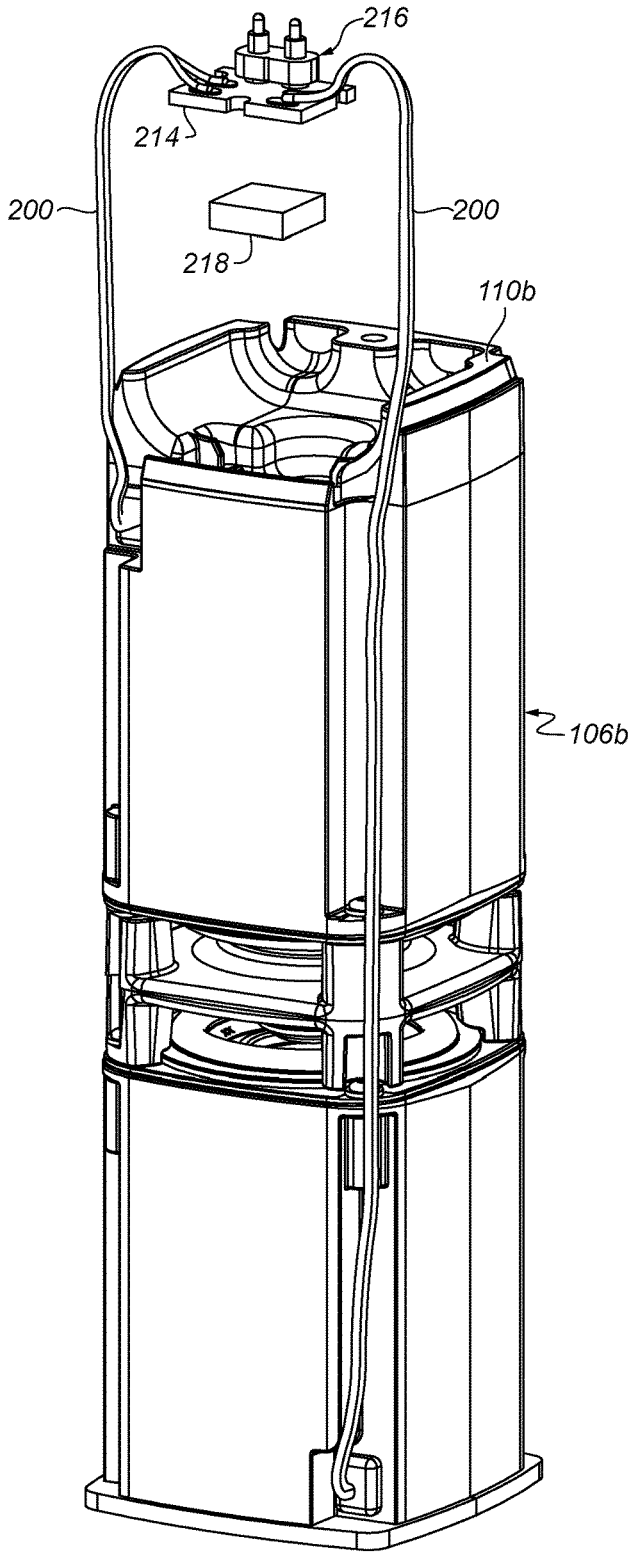

With reference to FIG. 2E, the second, free ends of the electrical wiring 200 for the acoustic drivers are attached to a printed wiring board (PWB 214), which also supports an electrical connector 216 for providing external electrical connection (e.g., to a source of audio signals (not shown)). The PWB 214 is arranged adjacent to the base 110*b* of the second acoustic enclosure 106*b*. A compliant member 218 (e.g., a piece of foam) is disposed between the base 110*b* of the second acoustic enclosure 106*b* and the PWB 214. As described below, the compliant member 218 serves to bias the PWB 214 against an end cap (item 230*b*, FIG. 2F) in the finished assembly.

Figure 2F:
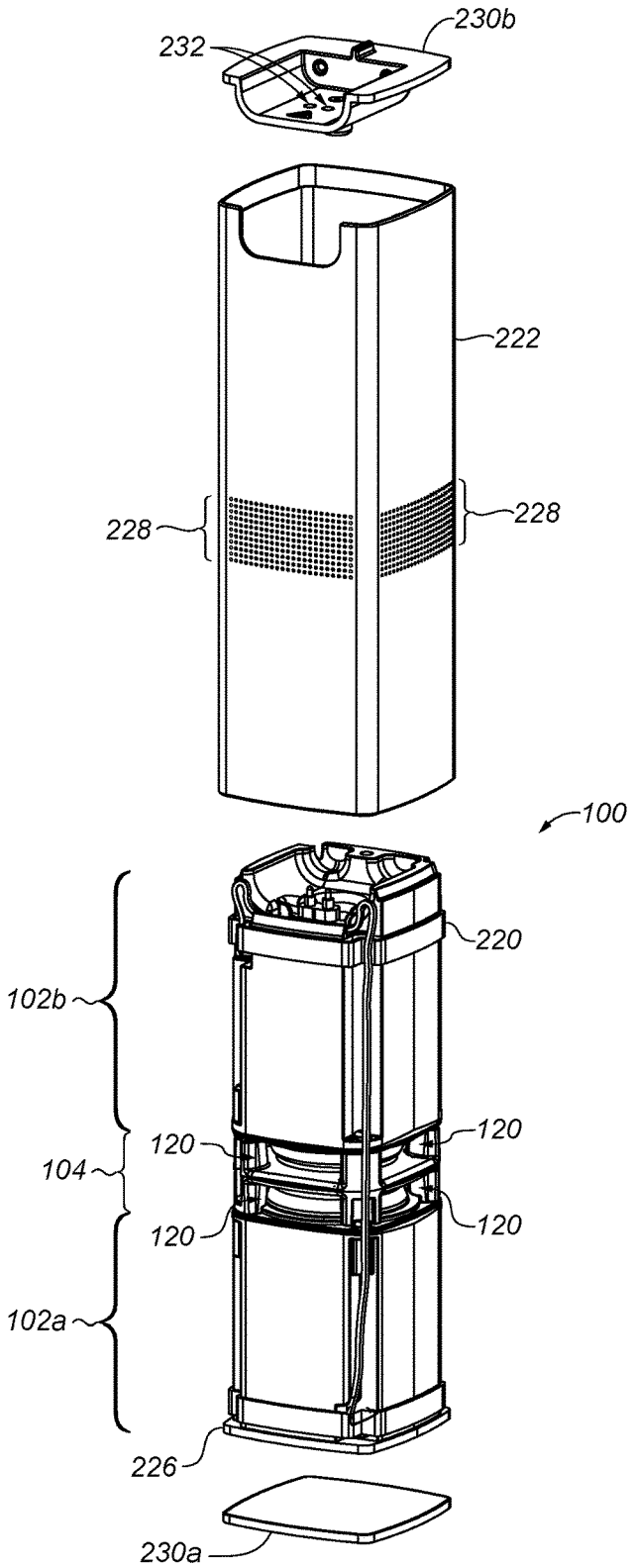
Figure 3:
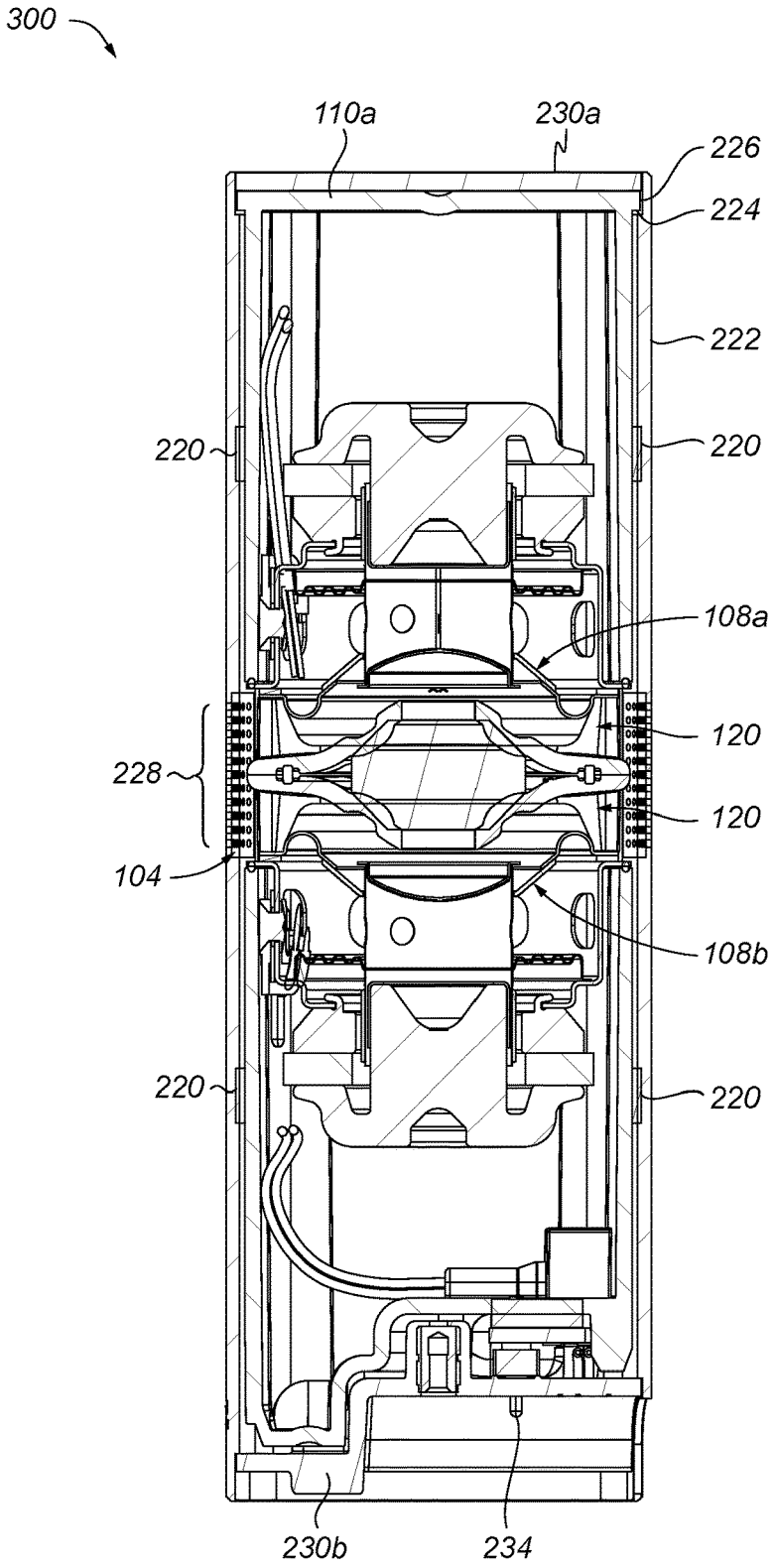
FIG. 3 is a cross-sectional side view of an omni-directional speaker system.

Referring to FIGS. 2F and 3, a band of vibration absorbing material 220 is wrapped around each of the acoustic sub-assemblies 102, and then a hollow outer sleeve 222 is slid over the acoustic assembly 100. The sleeve 222 is slid over the acoustic assembly from the second acoustic sub-assembly 102*b* toward the first acoustic sub-assembly 102*a*, such that a first recess 224 (FIG. 3) formed at a first open end of the sleeve 222 comes to rest above a lip 226 formed around the base 110*a* of the first acoustic enclosure 106*a*. In that regard, the lip 226 is only used as a hard stop for drop—there is a gap for buzz prevention. The sleeve 222 may be formed from a rigid material, such as plastic or metal (e.g., aluminum), and includes regions 228 of perforations which align with the openings 120 in the acoustic assembly 100 to permit the passage of the acoustic energy that is radiated from the acoustic drivers 108 and deflected by the deflector sub-assembly 104. The vibration absorbing material 220 helps to inhibit buzzing (undesirable noise) that may otherwise be caused by relative movement of the acoustic assembly 100 and the sleeve 222 during operation of the omni-directional speaker system 300 (FIG. 3).

Finally, first and second end caps 230*a*, 230*b* are arranged at first and second open ends of the sleeve 222, respectively, to provide a finished appearance. In that regard, a first end cap 230*a* is coupled to the base 110*a* of the first acoustic enclosure 106*a* (e.g., via adhesive such as a pressure sensitive adhesive), and the second end cap 230*b* is coupled to the sleeve 222 at the second open end of the sleeve 222 and the second acoustic enclosure 106*b* (e.g., via adhesive such as hot melt polyethylene).

The second end cap 230*b* includes apertures 232 to permit terminals 234 of the electrical connector 216 to pass therethrough. As mentioned above, the compliant member 218 biases the PWB 214 against the second end cap 230*b* to help ensure that the terminals 234 protrude through the apertures 232 a sufficient distance the enable a sufficient electrical connection and with enough pre-load to prevent buzz.

Figure 4:
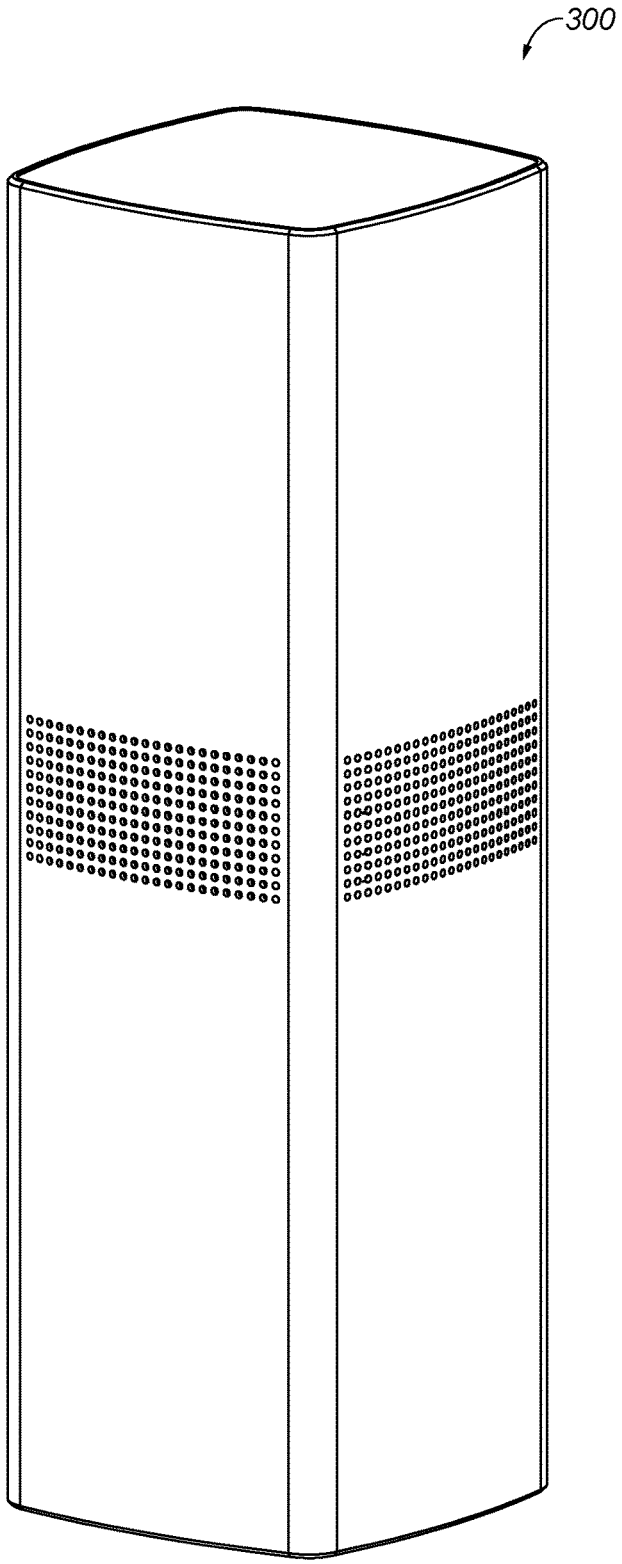
FIG. 4 is a perspective view of the omni-directional speaker system of FIG. 3.

As shown in FIG. 4, the assembled omni-directional speaker system 300 has a smooth outer appearance with an absence of seams along the length of the sleeve and no visible mechanical fasteners.

In general, omni-directional acoustic deflectors according to principles described herein act as an acoustic smoothing filter by providing a modified acoustic resonance volume between the acoustic driver and the acoustic deflector. It will be appreciated that adjusting the size and locations of the acoustically absorbing regions allows for the acoustic spectrum to be tuned to modify the acoustic spectrum. Similarly, the profile of the acoustically reflecting surface may be non-linear (i.e., vary from a perfect conical surface) and defined so as to modify the acoustic spectrum. In addition, non-circularly symmetric extensions in the acoustically reflecting surface, such as the radial extensions described above, can be utilized to achieve an acceptable acoustic spectrum.

A number of implementations have been described. Nevertheless, it will be understood that additional modifications may be made without departing from the scope of the inventive concepts described herein.

What is claimed is:

1. An omni-directional speaker system, comprising:

a deflector sub-assembly comprising a pair of diametrically opposed acoustic deflectors defining a common acoustic chamber, each of the acoustic deflectors having an opening coupled to the common acoustic chamber; and a pair of acoustic sub-assemblies each comprising an acoustic driver for radiating acoustic energy toward an associated one of the acoustic deflectors, wherein the acoustic sub-assemblies are coupled together via the deflector sub-assembly.

2. The omni-directional speaker system of claim 1, wherein each of the acoustic sub-assemblies comprises an acoustic enclosure, and wherein the deflector sub-assembly is coupled to the acoustic sub-assemblies so as to enable formation of respective acoustic seals at respective junctions between associated ones of the acoustic drivers and the acoustic enclosures.

3. The omni-directional speaker system of claim 1, wherein the pair of acoustic sub-assemblies comprises a first acoustic sub-assembly comprising a first acoustic driver and a first acoustic enclosure, wherein the first acoustic driver is coupled to the first acoustic enclosure via a first pair of fasteners partially forming a first acoustic seal at a junction between the first acoustic driver and the first acoustic enclosure, and wherein the deflector sub-assembly is coupled to the first acoustic sub-assembly via a second pair of fasteners so as to complete the first acoustic seal.

4. The omni-directional speaker system of claim 3, wherein each fastener of the second pair of fasteners passes through respective holes in the deflector sub-assembly and the first acoustic driver, and threadingly engages the first acoustic enclosure.

5. The omni-directional speaker system of claim 4, wherein the pair of acoustic sub-assemblies further comprises a second acoustic sub-assembly comprising a second acoustic driver and a second acoustic enclosure, wherein the second acoustic driver is coupled to the second acoustic enclosure via a third pair of fasteners partially forming a second acoustic seal at a junction between the second acoustic driver and the second acoustic enclosure, and wherein the deflector sub-assembly is coupled to the second acoustic sub-assembly via a fourth pair of fasteners so as to complete the second acoustic seal.

6. The omni-directional speaker system of claim 5, wherein each fastener of the fourth pair of fasteners passes through respective holes in the second acoustic enclosure and the second acoustic driver, and threadingly engages the deflector sub-assembly.

7. The omni-directional speaker system of claim 1, wherein the deflector sub-assembly comprises a plurality of vertical legs, and wherein the deflector sub-assembly is coupled to the acoustic sub-assemblies via the vertical legs.

8. The omni-directional speaker system of claim 7, wherein the deflector sub-assembly is coupled to a first one of the acoustic sub-assemblies via a first diametrically opposed pair of the vertical legs, and wherein the deflector sub-assembly is coupled to a second one of the acoustic sub-assemblies via a second diametrically opposed pair of the vertical legs.

9. The omni-directional speaker system of claim 1, wherein the deflector sub-assembly comprises an acoustically absorbing material within the acoustic chamber.

10. The omni-directional speaker system of claim 9, wherein the acoustically absorbing member is foam that extends into the openings of each of the acoustic deflectors.

11. The omni-directional speaker system of claim 10, wherein the acoustically absorbing member is held in a compressed state by the pair of diametrically opposed acoustic deflectors.

12. The omni-directional speaker system of claim 11, wherein the compression of the acoustically absorbing member changes an acoustic property of the acoustically absorbing member.

13. A method of assembling an omni-directional acoustic assembly, the method comprising:

coupling a deflector sub-assembly comprising a pair of diametrically opposed acoustic deflectors defining a common acoustic chamber to a first acoustic sub-assembly comprising a first acoustic enclosure and a first acoustic driver such that the first acoustic driver is arranged to radiate acoustic energy toward a first one of the acoustic deflectors; and coupling the deflector sub-assembly to a second acoustic sub-assembly comprising a second acoustic driver and a second acoustic enclosure such that the second acoustic driver is arranged to radiate acoustic energy toward a second one of the acoustic deflectors, wherein each of the acoustic deflectors have an opening coupled to the common acoustic chamber.

14. The method of claim 13, wherein the step of coupling the deflector sub-assembly to the first acoustic sub-assembly completes a first acoustic seal at a junction between the first acoustic driver and the first acoustic enclosure.

15. The method of claim 13, wherein the step of coupling the deflector sub-assembly to the first acoustic sub-assembly comprises passing a fastener through respective holes in the deflector sub-assembly and the first acoustic driver, and screwing the fastener into threaded engagement with the first acoustic enclosure.

16. The method of claim 13, wherein the step of coupling the deflector sub-assembly to the second acoustic sub-assembly comprises passing a fastener through respective holes in the second acoustic enclosure and the second acoustic driver, and screwing the fastener into threaded engagement with the deflector sub-assembly.

17. The method of claim 13, wherein the step of coupling the deflector sub-assembly to the first acoustic sub-assembly comprises passing a first pair of fasteners through respective holes in the deflector sub-assembly and the first acoustic driver, and screwing the first pair of fasteners into threaded engagement with the first acoustic enclosure; and wherein the step of coupling the deflector sub-assembly to the second acoustic sub-assembly comprises passing a second pair of fasteners through respective holes in the second acoustic enclosure and the second acoustic driver, and screwing the second pair of fasteners into threaded engagement with the deflector sub-assembly.

* * * * *